United States Patent [19]

Dürr et al.

[11] Patent Number: 4,941,821

[45] Date of Patent: Jul. 17, 1990

[54] METHOD AND APPARATUS FOR THE HEAT TREATMENT OF FINE-GRAINED MATERIAL

[75] Inventors: Manfred Dürr, Oelde; Georg Unland, Ennigerloh; Wolfgang Rother, Oelde; Günter Driemeier, Lienen; Heinz-Herbert Schmits, Rheda-Wiedenbrück, all of Fed. Rep. of Germany

[73] Assignee: Krupp Polysius AG, Fed. Rep. of Germany

[21] Appl. No.: 292,992

[22] Filed: Jan. 3, 1989

[30] Foreign Application Priority Data

Jan. 14, 1988 [DE] Fed. Rep. of Germany ..... 3800895

[51] Int. Cl.[5] ..... F27B 15/00; F27B 7/02

[52] U.S. Cl. ..... 432/106; 432/14; 432/58

[58] Field of Search ..... 432/14, 106, 58

[56] References Cited

U.S. PATENT DOCUMENTS 4,381,916 5/1983 Warshawsky ..... 432/58

4,470,849 9/1984 Abelitis et al. ..... 432/106

*Primary Examiner*—Henry C. Yuen

*Attorney, Agent, or Firm*—Learman & McCulloch

[57] ABSTRACT

The invention relates to a method and to apparatus for the heat treatment of fine-grained material using a calcination zone which is arranged between a preheating zone and a final combustion zone, and after passing through the calcination zone a proportion of the material is introduced into exhaust air from the cooling zone and delivered therewith back to the calcination zone for the purpose of recirculation. In this way a good burn-out of the fuel used in the calcination zone and a high degree of deacidification of the material are achieved.

9 Claims, 5 Drawing Sheets

METHOD AND APPARATUS FOR THE HEAT TREATMENT OF FINE-GRAINED MATERIAL

The invention relates to a method and to apparatus useful in the heat treatment of fine-grained material, particularly the burning of cement.

BACKGROUND OF THE INVENTION

A standard form of fine-grained material treatment is disclosed in EP-B-2 054.

Because of the high gas speeds used in order to increase efficiency, the material to be calcined passes through the calcination zone very quickly. Consequently there is little time available for the transfer of heat energy from the fuel to the material to be calcined. If fuels which ignite badly or are slow to burn out are used in the calcination zone, the fuel cannot be fully burnt out in the calcination zone and consequently its heat energy cannot be completely transferred to the material. This results in incomplete burn-out and insufficient deacidification of the material.

The prior art also includes a method (DE-B-22 47 172) in which an adjustable proportion of the material discharged from the lowest cyclone of the preheater is delivered to an additional combustion chamber and is heated there using fuel and exhaust air from the cooler before it then returns to the lowest cyclone of the preheater. Thus with this method an adjustable proportion of the material is deacidified in the additional combustion chamber before it reaches the rotary kiln. However, with this known method it is not reliably ensured that after preheating all particles of the material undergo heating and deacidification in the additional combustion chamber before they reach the rotary kiln for final burning.

A method is also known from DE-C-1 303 507 in which a proportion of the material discharged from the lowest stage of the cyclone preheater is introduced into the exhaust gas pipe leading to this lowest stage and led back to the lowest cyclone stage. Thus with this method a proportion of the preheated material carries out a circuit in the lowest cyclone stage. A calcination zone for heating and deacidification of the preheated material (before it enters the rotary kiln) is not provided in this known method.

The object of the invention is to provide a method and apparatus which function in such a way that even with fuel which ignites badly or burns out with difficulty, and particularly with inferior fuel, an improved burn-out in the calcination zone is achieved as well as a higher degree of deacidification of the material to be calcined.

SUMMARY OF THE INVENTION

According to the invention, after passing through the calcination zone a proportion of the material is introduced into exhaust air from the cooling zone and is led back therewith to the calcination zone for the purpose of recirculation. A substantial proportion of the solid fuel which has not yet been completely burnt out is recirculated at the same time with the material to be calcined in the calcination zone. In this way a considerably longer period of dwell is achieved for the material and the fuel in the calcination zone and as a result a better burn-out of the fuel and a higher degree of deacidification of the material are achieved.

In the method according to the invention the recirculated proportion of the material is introduced into exhaust air from the cooling zone and delivered pneumatically thereby to the calcination zone. Thus after the first passage through the calcination zone the material to be calcined as well as the fuel particles recirculated with the material enter an oxygen-rich atmosphere with at the same time a high temperature level. In this way optimum conditions are created for a quick and complete burn-out of the fuel and a high degree of deacidification of the material.

THE DRAWINGS

FIGS. 1–5 are schematic representations of various embodiments of apparatus each forming a part of the present invention.

DETAILED DESCRIPTION

Figure 1:
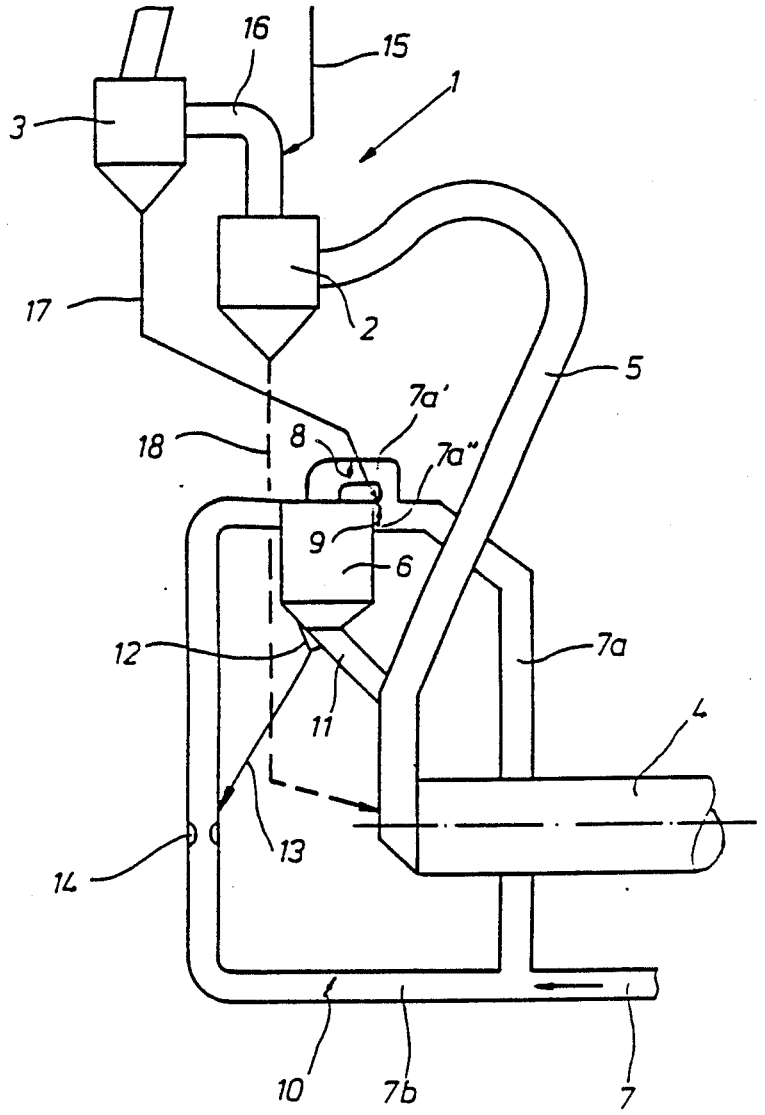

The apparatus according to FIG. 1 contains a multistage preheater 1 of which only the two lowest cyclones 2 and 3 are shown.

The apparatus also contains a rotary kiln 4 which is connected to the lowest cyclone 2 of the preheater 1 by a kiln exhaust gas pipe 5 constructed as a loop.

A calcination zone which is essentially formed by a combustion chamber 6 serves for heating and deacidification of the material preheated in the preheater 1 (before the material enters the rotary kiln 4). The upper region of this combustion chamber 6 is connected to a tertiary air pipe 7 which delivers exhaust air from a cooler arranged after the rotary kiln 4 (but not shown in FIG. 1) to the combustion chamber 6. The tertiary air pipe 7 branches first of all into two branch pipes *7a, 7b* of which the branch pipe *7a* is divided again into sub-branches *7a', 7a''*. The pipes *7b* and *7a''* preferably open tangentially on the periphery of the combustion chamber 6, whilst the sub-branch *7a'* is connected to the cover of the combustion chamber 6.

Flap valves 8, 9, 10 are provided for adjustment of the quantities of air in the individual pipes *7a', 7a'', 7b*.

An exhaust gas connection 11 which opens into the kiln exhaust gas pipe 5 is provided in the lower region of the combustion chamber 6. This exhaust gas connection 11 which is constructed like a chute at the same time constitutes a first material discharge connection for the combustion chamber 6.

A second material discharge connection 12, which is provided in the lower region of the combustion chamber 6, is linked by a material pipe 13 to the branch pipe *7b* of the tertiary air pipe 7. The material pipe 13 opens into the branch pipe *7b* above a throttle point 14 provided in the branch pipe *7b*.

The cyclones of the preheater 1 are connected to one another in a known manner by their gas and material pipes. Thus the material discharge pipe 15 of the third cyclone (which is not shown) opens into the gas pipe 16 which connects the lowest cyclone 2 to the second-lowest cyclone 3.

The material discharge pipe 17 of the cyclone 3 opens into the sub-branch *7a''* of the tertiary air pipe, while the material discharge pipe 18 of the cyclone 2 is connected to the inlet housing of the rotary kiln 4.

The rotary kiln 4 is heated in a known manner by a burner at the material discharge end (which is not shown) of the kiln.

The combustion chamber 6 is also provided with at least one burner (not shown).

When the apparatus according to FIG. 1 is in operation the material preheated in the preheater 1 passes via the material discharge pipe 17 of the cyclone 3 into the subbranch 7a'' of the tertiary air pipe 7 and is further heated and deacidified in the combustion chamber 6. A proportion of the material is led out of the combustion chamber 6 together with the exhaust gases from this combustion chamber via the exhaust gas connection 11 and introduced into the kiln exhaust gas pipe 5, separated out of the gas stream in the cyclone 2 and delivered to the rotary kiln 4 via the material discharge pipe 18.

A further proportion of the material which is heated and deacidified in the combustion chamber 6 is drawn off via the material discharge connection 12 and the material pipe 13 and introduced into the branche pipe 7b of the tertiary air pipe 7. The tertiary air which passes through the throttle point 14 at high speed deflects the material delivered via the material pipe 13 and delivers it back to the combustion chamber 6. A certain proportion of the material calcined in the combustion chamber 6 therefore runs through the calcination zone more than once, which leads to an altogether longer period of dwell both for the material and for the fuel used in the combustion chamber 6.

The exhaust gas connection 11, which also serves as a material discharge connection, and the further material discharge connection 12 form an arrangement for division of the material which is advantageously provided with suitable means (such as flap valves) for achieving the desired distribution of material.

In the embodiments according to FIGS. 2 to 5, the same elements are designated by the same reference numerals as in FIG. 1, so that only the ways in which these variants deviate from the embodiment according to FIG. 1 will be explained below.

Figure 2:
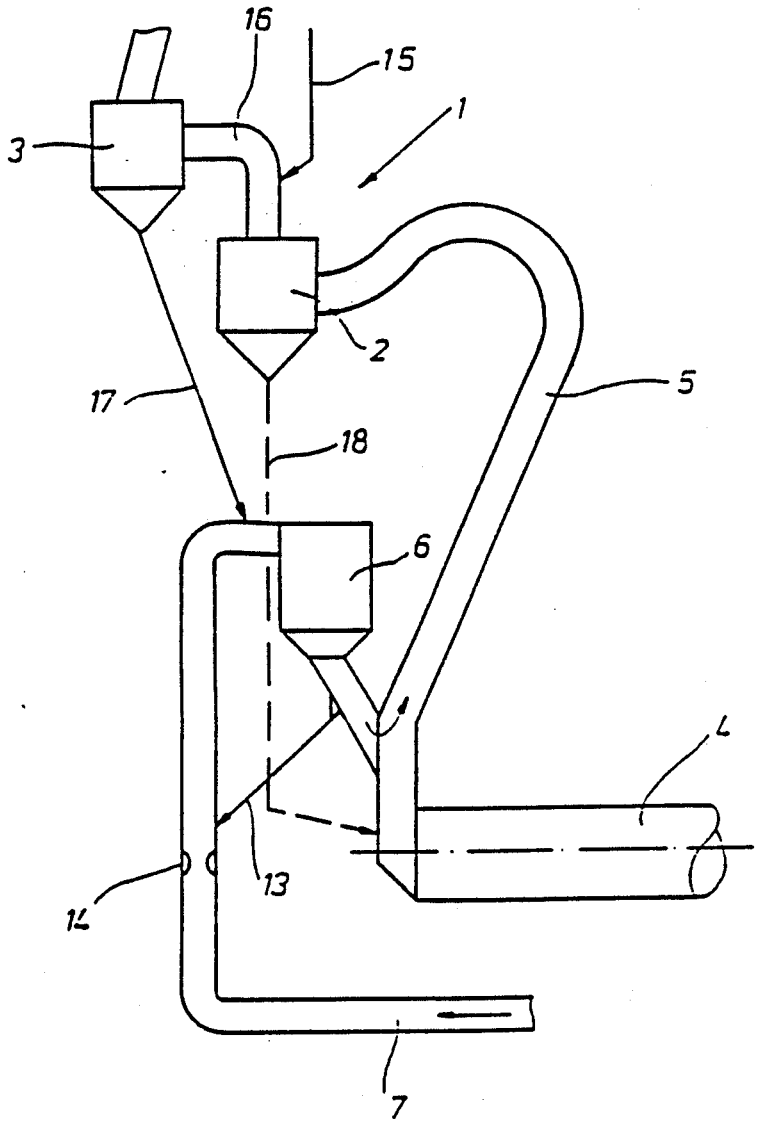

In the apparatus according to FIG. 2 the tertiary air pipe 7 is not branched. Consequently the combustion chamber 6 is only provided with one single air connection. The material discharge pipe 17 of the cyclone 3 opens into the tertiary air pipe 7 near the combustion chamber 6.

The material pipe 13 of the combustion chamber 6 is connected to the tertiary air pipe 7 right above the throttle point 14. Consequently the material recirculated via the material pipe 13 and the fuel carried along in this material stream but not yet completely burnt out first enter an air stream which is free of material and is very rich in oxygen and there they are evenly distributed over the entire cross-section before the preheated material delivered via the material discharge pipe 17 is introduced into this air stream (right before the point where the tertiary air pipe 7 opens into the combustion chamber 6) which already contains the recirculated material.

Figure 3:
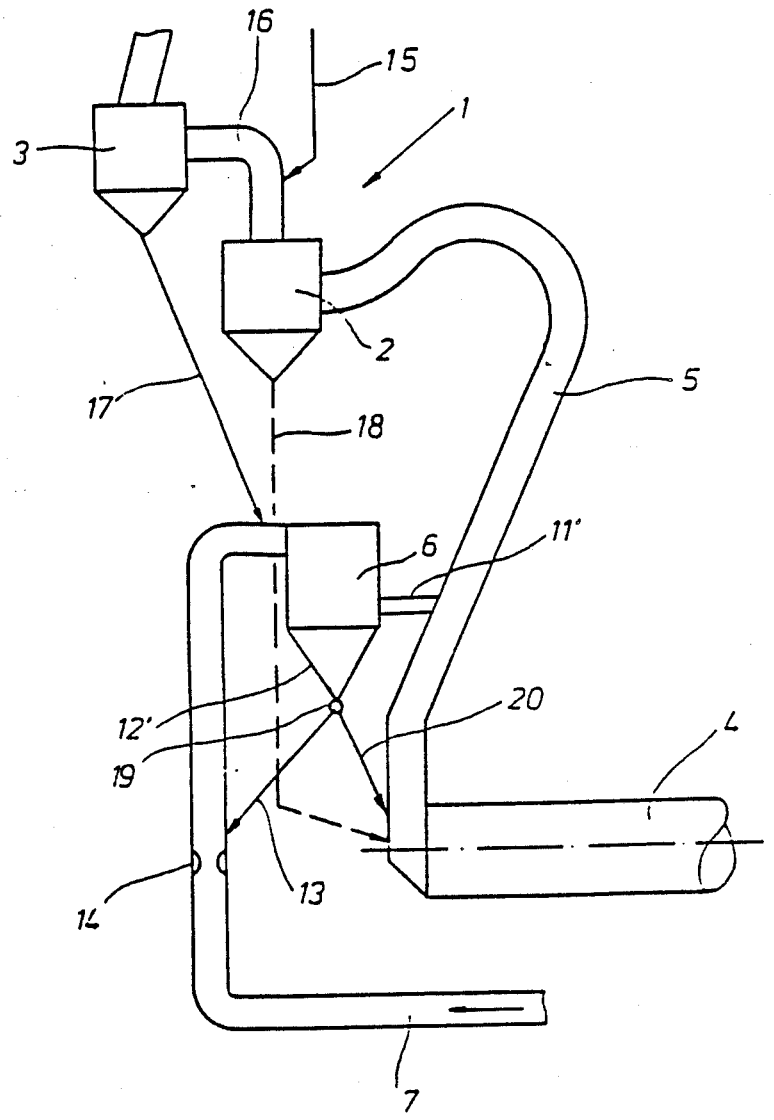

In the embodiment according to FIG. 3 the lower region of the combustion chamber 6 is connected by an exhaust gas connection 11' to the kiln exhaust gas pipe 5. Below this exhaust gas connection 11' is a separate material discharge connection 12' with an arrangement 19 which is only indicated schematically for division of the material. From this arrangement 19 (which may for example be a distributor flap) a material pipe 13 leads to the tertiary air pipe 7 and a material pipe 20 leads to the kiln exhaust gas pipe 5.

Apart from the separate gas extraction from the combustion chamber 6 the way in which the apparatus according to FIG. 3 functions corresponds to that of the embodiment according to FIG. 2. Here too the material from the combustion chamber 6 which is introduced via the material pipe 20 into the kiln exhaust gas pipe 5 is separated out of the gas stream in the cyclone 2 and then delivered to the rotary kiln 4, while the material recirculated via the material pipe 13 and the tertiary air pipe 7 passes through the combustion chamber 6 again.

Figure 4:
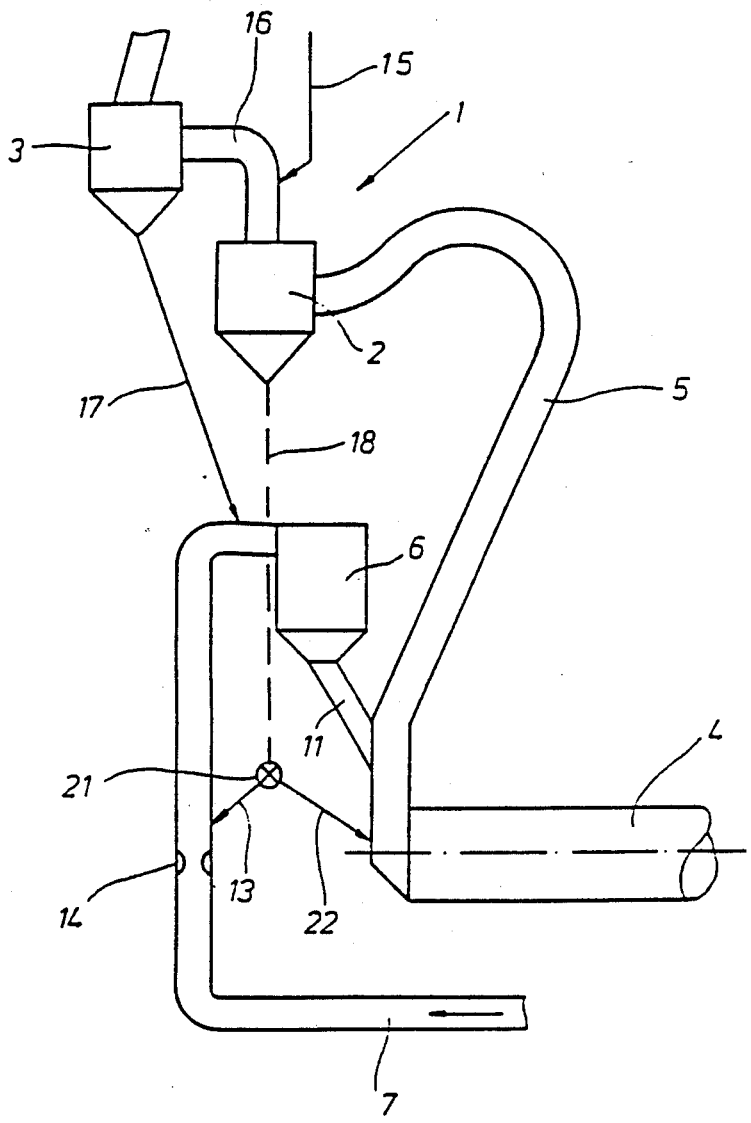

In the embodiment according to FIG. 4 the combustion chamber 6 has an exhaust gas connection 11 which at the same time forms the sole material discharge connection of the combustion chamber and is connected to the kiln exhaust gas pipe 5. The material discharge pipe 18 of the lowest cyclone 2 is connected to an arrangement 21 for division of the material from which a material pipe 13 leads to the tertiary air pipe 7 and a material pipe 22 leads to the inlet housing of the rotary kiln 4.

Thus in this example the division of the material calcined in the combustion chamber 6 does not take place directly after leaving the combustion chamber but only after separation in the cyclone 2; the proportion of the material which is introduced via the material pipe 13 into the tertiary air pipe 7 is recirculated into the combustion chamber 6 (and also passes again through the kiln exhaust gas pipe 5 and the cyclone 2), while the remaining proportion of the material passes directly to the rotary kiln via the material pipe 22. Thus in this embodiment the kiln exhaust gas pipe 5 is included in the recirculation as well as the combustion chamber 6.

Figure 5:
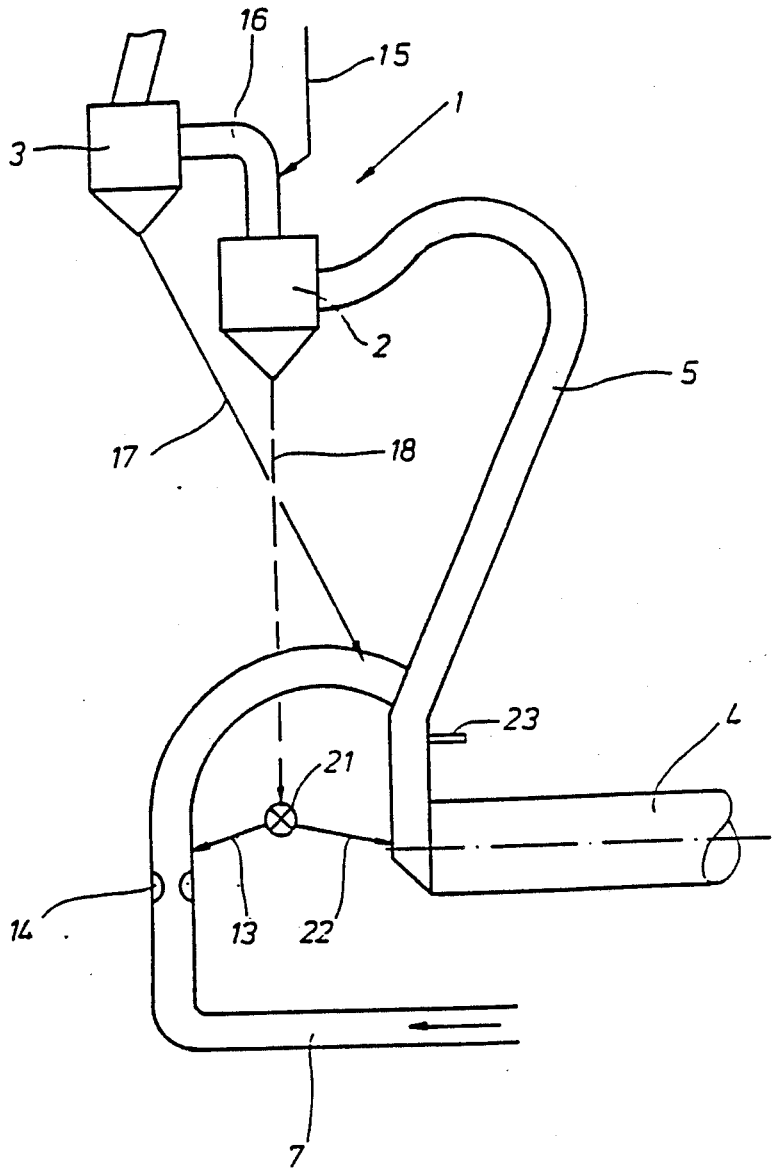

The embodiment according to FIG. 5 corresponds to the variant according to FIG. 4 with the difference that there is no separate combustion chamber 6. The calcination zone is formed by the kiln exhaust gas pipe 5, the lower region of which is provided with one or more burners 23. The teritary air pipe 7 opens directly into the kiln exhaust gas pipe 5, advantageously with a slight downwards inclination. The preheated material delivered via the material discharge pipe 17 is introduced into the tertiary air pipe near the point at which the tertiary air pipe 7 opens into the kiln exhaust gas pipe 5.

The material discharged via the material discharge pipe 18 is divided in the manner already explained in relation to FIG. 4, and the proportion recirculated via the material pipe 13 into the tertiary air pipe 7 again passes through the calcination zone, i.e. the kiln exhaust gas pipe 5.

In the embodiments according to FIGS. 1 to 4 (in which the combustion chamber 6 is provided as a calcination zone), one or more burners can also be provided in the lower region of the kiln exhaust gas pipe 5 in order to achieve a still higher degree of deacidification of the material.

What is claimed is:

1. Apparatus for the heat treatment of fine-grained material such as cement, said apparatus comprising material preheater means, a material calcination zone in communication with said preheater means, kiln means in communication with said preheater means to receive material therefrom for final burning of said material, cooling means in communication with said kiln means to receive and cool burnt material, tertiary air supply means extending from said cooling means to said calcination zone to deliver oxygen-rich cooling air thereto, exhaust gas supply means extending from said kiln means to said preheater means to deliver hot exhaust gas thereto, and means for delivering a portion of said material from a selected part of said apparatus to said tertiary air supply means for mixing with said cooling air and recycling to said calcination zone.

2. The apparatus of claim 1 wherein said selected part of said apparatus includes said calcination zone.

3. The apparatus of claim 1 including material flow throttle means forming a part of said tertiary air supply means, said means for delivering said portion of said material being in communication with said tertiary air supply means downstream of said throttle means.

4. The apparatus of claim 1 wherein said calcination zone comprises a combustion chamber provided with exhaust gas discharge means in communication with said exhaust gas supply means, and material discharge dividing means associated with said chamber to deliver a portion of discharged material to said exhaust gas supply means and a portion of discharged material to said tertiary air supply means for recycling to said chamber.

5. The apparatus of claim 1 wherein said calcination zone comprises a combustion chamber provided with exhaust gas and material discharge means in communication with said exhaust gas supply means whereby said material is returned to said preheater means, and material flow divider means forming a part of the communication between said preheater means and said kiln means to deliver said portion of said material to said tertiary air supply means.

6. The apparatus of claim 1 wherein said calcination zone is located within said exhaust gas supply means, and including combustion gas supply means in communication with said exhaust gas supply means, and material flow divider means forming a part of the communication between said preheater means and said kiln means to deliver a portion of material to said tertiary air supply means.

7. The apparatus of claim 4 wherein said tertiary air supply means includes at least two branch portions, the first of which is connected to said chamber and is in communication with said material discharge dividing means, the second of which is in communication with said preheater means and said chamber to receive material from said preheater means for introduction into said chamber.

8. The apparatus of claim 4 wherein said exhaust gas discharge means is arranged to deliver a portion of discharged material to said exhaust gas supply means.

9. The apparatus of claim 4 wherein said material discharge dividing means is separate from and positioned below said exhaust gas discharge means.

* * * * *